US005120096A

United States Patent [19]

D'Silva

[11] Patent Number: 5,120,096

[45] Date of Patent: Jun. 9, 1992

[54] MISLOADED IV TUBE DETECTOR FOR AN IV PUMP

[75] Inventor: Edmund D. D'Silva, Vernon Hills, Ill.

[73] Assignee: Baxter International Inc., Deerfield, Ill.

[21] Appl. No.: 765,354

[22] Filed: Sep. 25, 1991

Related U.S. Application Data

[62] Division of Ser. No. 572,054, Aug. 23, 1990, Pat. No. 5,090,877.

[51] Int. Cl.[5] ..... E05C 1/14; F04B 43/12

[52] U.S. Cl. ..... 292/241; 604/153; 292/DIG. 65; 292/DIG. 49

[58] Field of Search ..... 292/241, 201, DIG. 65, 292/240, DIG. 49; 604/151, 153

[56] References Cited

U.S. PATENT DOCUMENTS

| | | | |
|---|---|---|---|
| 2,322,948 | 6/1943 | Lofgren | 292/DIG. 65 X |
| 3,510,162 | 12/1967 | Smith et al. | 292/241 |
| 3,746,382 | 7/1973 | Hancock | 292/241 |
| 3,958,821 | 5/1976 | Scalera | 292/97 |
| 4,187,057 | 2/1980 | Xanthopoulos | 417/63 |
| 4,460,358 | 7/1984 | Somerville et al. | 604/250 |
| 4,487,604 | 12/1984 | Iwatschenko et al. | 604/153 |
| 4,725,205 | 2/1988 | Cannon et al. | 417/363 |
| 4,758,228 | 7/1988 | Williams | 604/153 |
| 4,793,643 | 12/1988 | Ahad et al. | 292/241 |
| 5,039,279 | 8/1991 | Natwick et al. | 417/63 |

FOREIGN PATENT DOCUMENTS 345681A 6/1988 European Pat. Off. .

*Primary Examiner*—Richard E. Moore

*Attorney, Agent, or Firm*—Paul E. Schaafsma; Amy L. H. Rockwell; Paul C. Flattery

[57] ABSTRACT

A peristaltic pump comprising a housing (19), including a base (21), a resilient tube (27) and a peristaltic pumping fingers (31) carried by the supporting structure. The tube (27) is positionable on the base (21) in a proper position and an improper position. In the proper position, the peristaltic pumping fingers (31) can properly progressively squeeze the tube to pump a fluid through the tube and in an improper position. A door (23) is mounted on the housing (19) for movement between an open position and a closed position. A latch (25) includes a pivotable latch member (51) on the door (23) and a fixed latch member (55) on the housing (19). The pivotable latch member (51) is movable between a latching position in which the door (23) is locked in the closed position and a releasing position in which the door (23) is not locked in the closed position. If the tube (27) is in the improper position, the pivotable latch member (51) is prevented from being placed in the latching position.

4 Claims, 4 Drawing Sheets

MISLOADED IV TUBE DETECTOR FOR AN IV PUMP

This is a division of application Ser. No. 07/572,054, filed on Aug. 23, 1990, now U.S. Pat. No. 5,090,877.

BACKGROUND OF THE INVENTION

A peristaltic pump typically includes a resilient tube and a peristaltic pumping member for progressively squeezing the tube to pump a fluid through the tube. The peristaltic pumping member may be, for example, a rotary cam or a series of fingers which reciprocate in the proper sequence to bring about progressive squeezing of the tube.

One common use for a peristaltic pump is in infusing parenteral fluids into a patient. One known form of infusion pump includes a supporting structure, including a base and a peristaltic pumping member carried by the supporting structure. The pump also includes a tube which is positionable on the base in a proper position in which the peristaltic pumping member can properly progressively squeeze the tube to pump fluid through the tube. Unfortunately, it is possible for the tube to assume an improper position on the base as a result of, for example, improperly threading the tube into a tube receiving groove in the base or over the peristaltic pumping member.

The pump also includes a door mounted on the supporting structure for movement between an open position in which the door allows access to the base and a closed position in which the door impedes access to the base. A latch, such as an overcenter toggle mechanism, can be used to draw the door to the closed position and to lock it in the closed position.

When the tube is in the proper position, the door can be readily moved to the closed position, and the latch can be easily and properly moved to its latching position. However, when the tube is in the improper position, it restrains the door against movement to the closed position. When this occurs, the operator may force the latch to the closed position thereby damaging the door and/or the base and compressing the tube in a way which creates a likelihood that the infusion pump will be unable to properly infuse the medical fluid into the patient. Furthermore, when this occurs, there is no notice or alarm provided to the operator.

SUMMARY OF THE INVENTION

The present invention solves this problem by positively preventing movement of the door to the closed position when the tube is in the improper position. This can be contrasted with the prior art in which the latch can be used to force the door to the closed position and to force the latch to its latching position even though the tube is in the improper position. Consequently, with this invention, the likelihood of damaging the door and base of the pump is reduced, and the risk of improperly infusing liquids into the patient is also reduced. In addition, the door provides a visual indication when it has been prevented from moving to the closed position. Although this invention is particularly adapted for use in a peristaltic pump, features of the invention are applicable to various assemblies which employ a door and a latch for locking the door in a closed position.

This invention also employs a latch carried by the door and the supporting structure. The latch has a latching position in which it retains the door in the closed position and a releasing position in which it allows the door to be moved to the open position. A feature of this invention is that the latch is prevented from being in the latching position when the tube is in the improper position.

In a preferred embodiment, the latch includes a first latch member on the door and a second latch member on the supporting structure, with the latch members being relatively movable between the latching position and the releasing position. Preferably, the first latch member is pivotally mounted on the door and is movable between the latching and releasing positions.

Another feature of this invention is that the means which prevents the latch from being in the latching position when the tube is in the improper position includes a portion of the first latch member. In a preferred embodiment, the first latch member includes a main body, and the preventing means includes an arm pivotally mounted on the main body and detent means for releasably retaining the arm in a normal position in which the arm can cooperate with the second latch member to at least assist in moving the first latch member to the latching position. The arm is movable out of the normal position in response to forcing the door toward the closed position with the tube in the improper position.

The main body, the arm and the second latch member can advantageously form an overcenter toggle mechanism which is over center in the latching position to draw the door to the closed position and to lock the door in the closed position. A feature of this invention is that the arm and the detent means form breakaway means on the toggle mechanism which is responsive to a predetermined force on the toggle mechanism to prevent movement of the latch to the latching position.

It is known to provide a switch, such as a reed switch, on the supporting structure and a switch operator on the pivoting latch member for the purpose of providing a "door open" alarm whenever the latch is not in the latching position. The present invention provides for a switch carried by one of the supporting structure and the arm and a switch operator carried by the other of the supporting structure and the arm. With this arrangement, the switch is placed in one state by the switch operator when the latch is in the latching position and in a second state when the latch is not in the latching position.

When the arm is moved out of the normal position, it can be easily reset back to the detented or normal position. This is preferably accomplished by a reset member carried by the arm and engageable with a stop on the door to urge the arm back to the normal position when the first latch member is moved to a reset location. The releasing position includes a range of positions, and the reset location is at one of such positions.

The invention, together with additional features and advantages thereof, such as a novel detent means, may best be understood by reference to the following description taken in connection with the accompanying illustrative drawing.

DESCRIPTION OF THE PREFERRED EMBODIMENT

Figure 1:
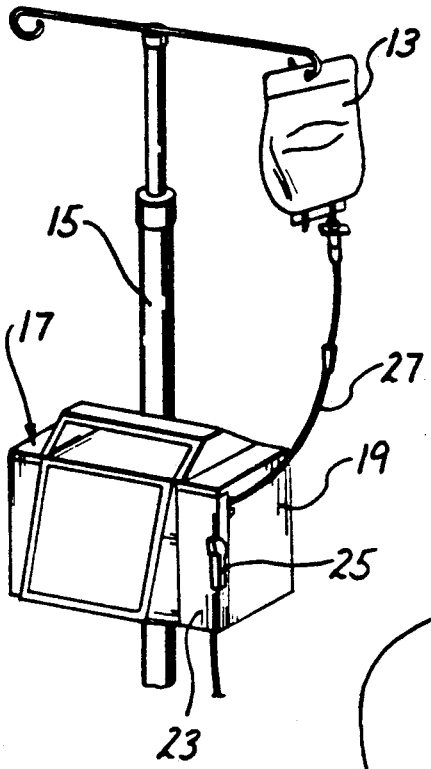
FIG. 1 is a perspective view of an infusion system incorporating the peristaltic pump of this invention.

FIG. 1 shows an infusion system 11 for infusing liquid into a patient comprising a bag 13 of infusable liquid, such as medication, a saline solution, etc., a stand 15 and a pump 17 mounted on the stand. The bag 13 is supported on the stand 15 above the pump 17.

Figure 2:
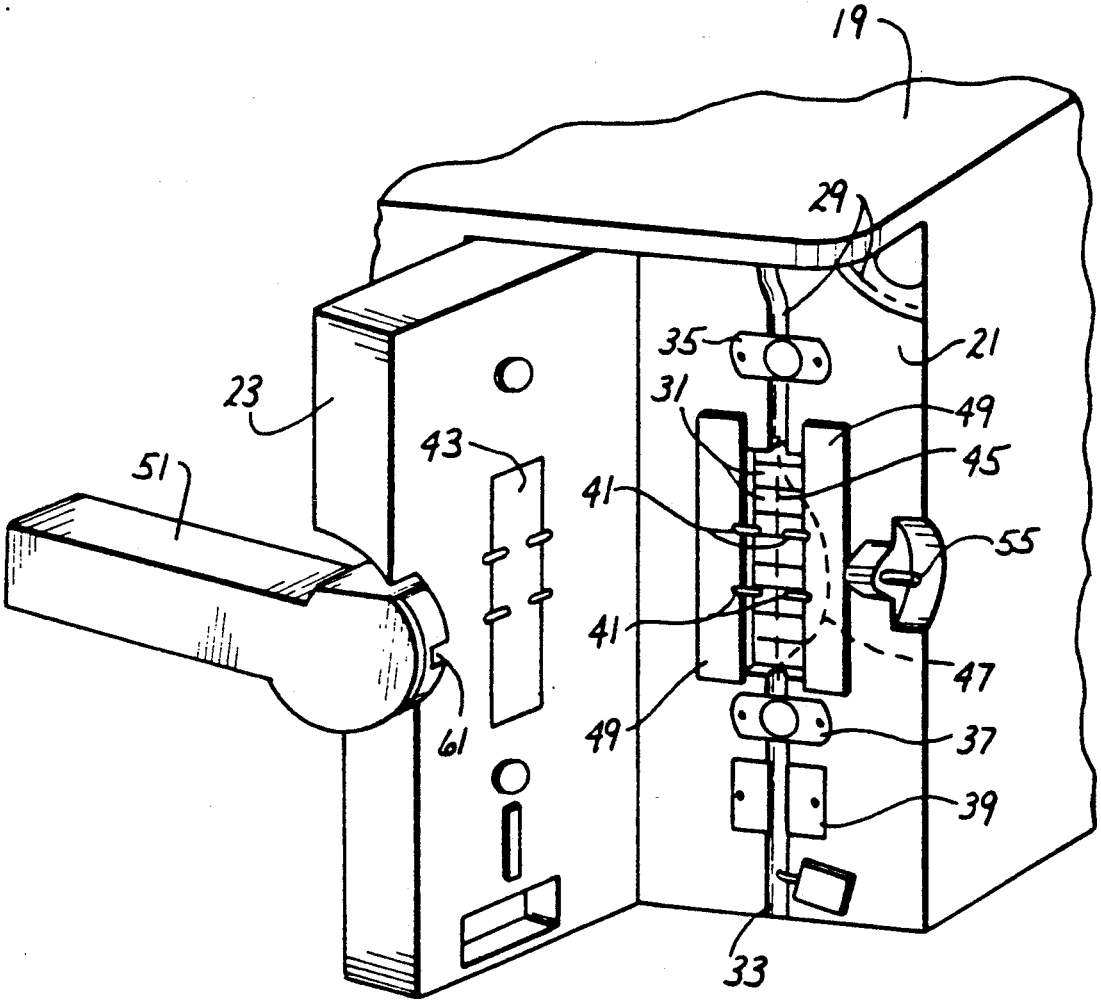
FIG. 2 is a fragmentary perspective view illustrating portions of the peristaltic pump with the door in the open position and the latch in the releasing position.
Figure 4:
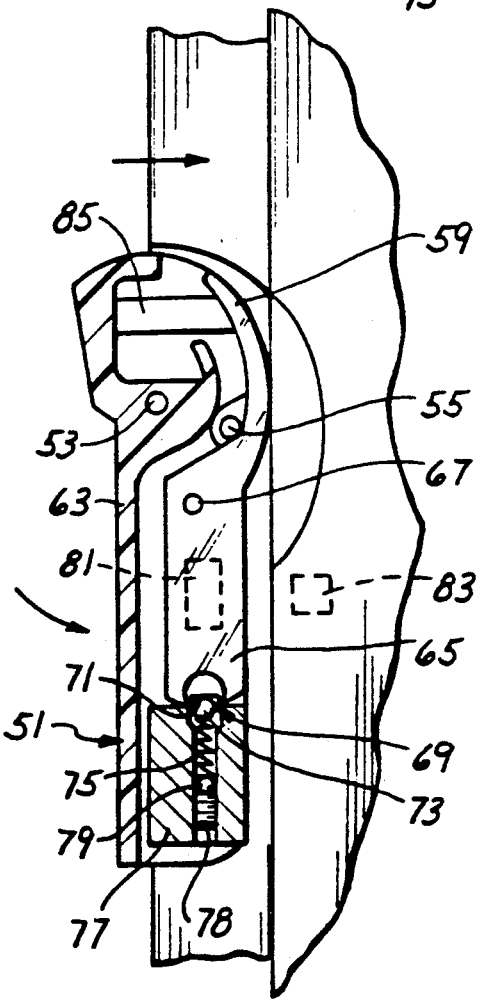
FIG. 4 is a fragmentary elevational view partially in section similar to FIG. 3 with the door in the closed position and the latch in the latching position.

The pump 17 comprises a supporting structure which includes a housing 19 and a base 21 (FIG. 2). A door 23 is mounted on the housing 19 for pivotal movement about a vertical pivot axis between an open position (FIG. 2) and a closed position (FIGS. 1 and 4). A latch 25 can be moved between a latching position (FIG. 4) in which the door is latched or locked in the closed position and a releasing position (FIG. 2) in which the door is not locked in the closed position.

The pump 17 includes a resiliently deformable tube 27 that extends from the bag 13 downwardly through the housing 19. The base 21 has an inlet groove 29 leading to a peristaltic pumping member in the form of a plurality of reciprocable fingers 31. An outlet groove 33 is formed in the base 21 and leads from the fingers 31 downwardly to the exterior of the housing 19.

The pump 17 may also include other conventional components, including an upstream occlusion sensor 35, a downstream occlusion sensor 37, an air bubble detector 39 and tube guides 41. The pump 17 also includes a spring loaded back plate 43 of conventional construction carried by the door 23 in a conventional manner. The back plate 43 serves as an anvil for the fingers 31. The tube 27 can be loaded into the housing 19 in a proper position as shown by the dashed line 45 in FIG. 2. In the proper position, the tube is loaded into the inlet groove 29, extends straight across the fingers 31 as shown in FIG. 2 and is also loaded into the outlet groove 33. In the proper position of the tube and with the door 23 locked in the closed position, the fingers 31 reciprocate to progressively squeeze the tube 27 against the plate 43 to pump fluid through the tube in peristaltic pumping fashion.

However, the tube 27 can be loaded into the housing 19 in an improper position. One example of an improper position is shown by the dashed line 47 in FIG. 2 in which the tube 27 makes a loop around some of the fingers 31. In this position, the tube 27 overlies one of the shims 49 which are attached to the base 21 and extend along the opposite sides of the fingers 31. The shims 49 may be constructed of a hard rubber or other relatively hard, incompressible material, and they may be adhered to the base 21 or to the door 23. Because the fingers 31 are recessed into the base 21, if the tube 27 overlies one of the shims 49, it projects so far out toward the door 23 that it can restrain the door against closing.

The line 47 in FIG. 2 is only one form of improper position of the tube 27. More generally, any deviation of the tube 27 from the line 45 which results in the tube lying along the base 21 or the shims 49 or that would force the tube outwardly toward the door so as to restrain the door against movement to the closed position is also an improper position of the tube.

Figure 3:
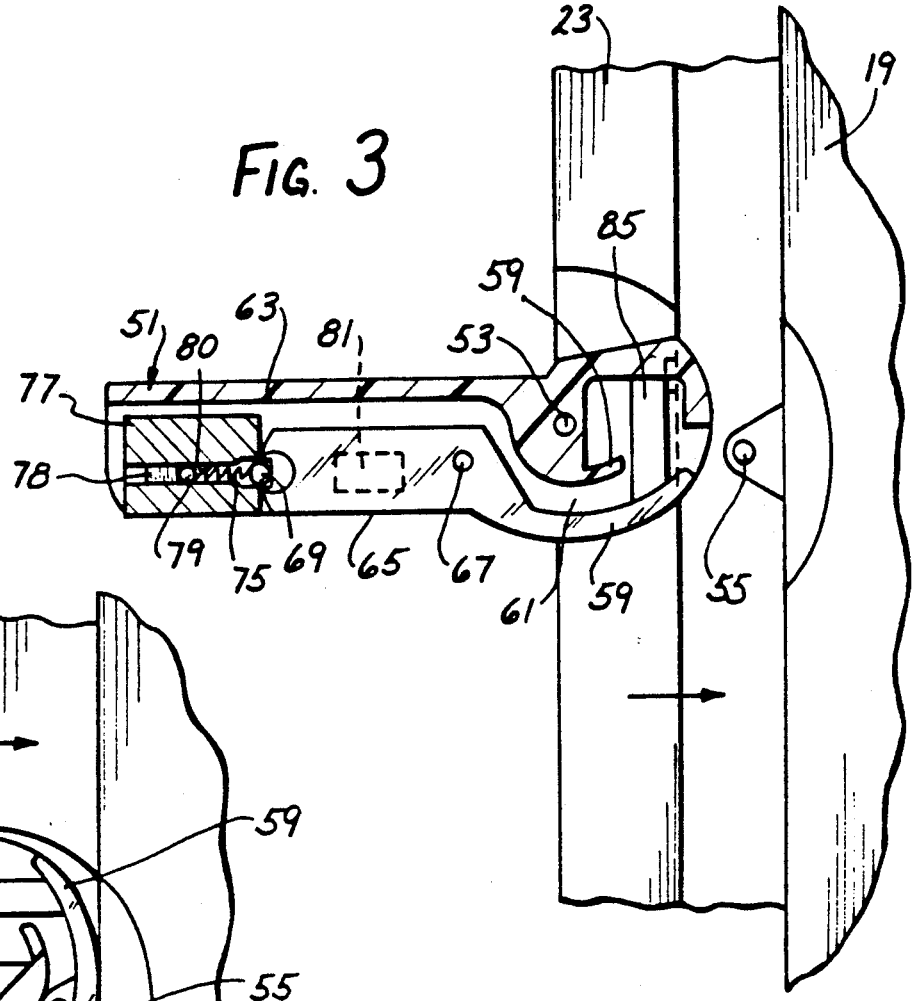
FIG. 3 is a side elevational view partially in section illustrating the door in the open position and the latch in the releasing position, with the door approaching the closed position.

The latch 25 includes a first or pivotable latch member 51 pivotally mounted on the door 23 by a pin 53 (FIG. 3) and a second or fixed latch member 55 fixedly mounted on the housing 19. The pivotable latch member 51 is pivotable between a latching position in which the door 23 is locked in the closed position (FIG. 4) and a releasing position in which the door is not locked in the closed position. The pivotable latch member 51 has a pair of jaws 57 and 59 spaced apart to define a slot 61 adapted to receive the fixed latch member 55. Thus, as shown in FIG. 3, with the tube 27 in the proper position and the pivotable latch member in the releasing position, the door 23 can be moved toward the closed position so that the fixed latch member 55 can be received in the end of the groove 61. Thereafter, the pivotable latch member 51 can be pivoted counterclockwise as viewed in FIGS. 3 and 4 from the horizontal position of FIG. 3 to the vertical position of FIG. 4. The latch members 51 and 55 are arranged so as to form a overcenter toggle mechanism. As the pivotable latch member 51 is pivoted to the latching position, it draws the door to the closed position shown in FIG. 4.

If the tube 27 is in the improper position, it protrudes sufficiently into the path of the door 23 that it restrains the door against movement to the closed position. With the prior art, the user might attempt to force the toggle mechanism latch to the closed position, and in so doing, might damage the door and/or the base. In addition, forcing of the toggle mechanism to the latching position in the prior art might compress the tube 27 so as to interfere with, or prevent, the pumping of liquid through the tube to the patient.

The present invention solves this problem by positively preventing movement of the door 23 to the closed position and preventing the pivotable latch member 51 from being in the latching position when the tube 27 is in the improper position. To accomplish this, in the preferred embodiment, the pivotable latch member 51 includes a main body 63, which is pivoted to the door 23 by the pin 53, an arm 65 pivotally mounted on the main body 63 by a pin 67 and detent means 69 for releasably retaining the arm in a normal position shown in FIGS. 3-5. The main body is preferably integrally molded from a suitable rigid plastic material, and the arm is preferably constructed of a metal.

The detent means 69 can be of various different constructions and, in this embodiment comprises a hardened steel insert mounted on one end of the arm 65 and defining a recess in the form of a groove 71 at one end of the arm 65, a detent member in the form of a roller 73 and a spring 75 for biasing the roller into the groove. The roller 73 and the spring 75 may be conveniently provided in a metal detent block 77 mounted on, and carried by, the main body 63. Alternatively, the detent block 77 can be molded integrally of a plastic material with the pivotable latch member 51. The detent means 69 also includes a rotatable member in the form of a set screw 78 for adjusting the force with which the spring 75 urges the roller 73 into the groove 71 and a ball 79, which serves as a bearing between the set screw and the spring to facilitate rotation of the set screw without interference from the spring. The spring 75, the set screw 78, the ball 79 and a portion of the roller 73 are received in a bore 80 in the detent block 77, and the set screw is threadedly received in the bore to enable it to variably compress the spring 75 against the detent roller 73 by rotation of the set screw.

The detent 69 has at least two important features. First, the use of the detent roller 73, which is in the form of an elongated cylinder, rather than a ball, provides a relatively long region of contact with the groove 71, which is similarly elongated. This can be contrasted with the usual ball detent which provides a relatively smaller region of contact between the ball and the recess in which the ball is received. Secondly, the ball 79 provides the advantageous function of acting as a bearing between the rotatable set screw 78 and the rotationally stationary spring 75 to prevent the spring from interfering with the rotation of the set screw and to prevent the rotation of the set screw from adversely affecting the spring.

The arm 65 defines the jaw 59. With the detent ball 73 biased into the groove 71, the arm 65 is releasably retained or detented in a normal position in which the arm, and in particular the jaw 59, can cooperate with the fixed latch member 55 to move the pivotable latch member to the latching position of FIG. 4 as described above. However, by applying sufficient force to the jaw 59 in a direction tending to pivot the arm 65 about the pin 67, the arm can be moved out of the normal or detented position.

Figure 5:
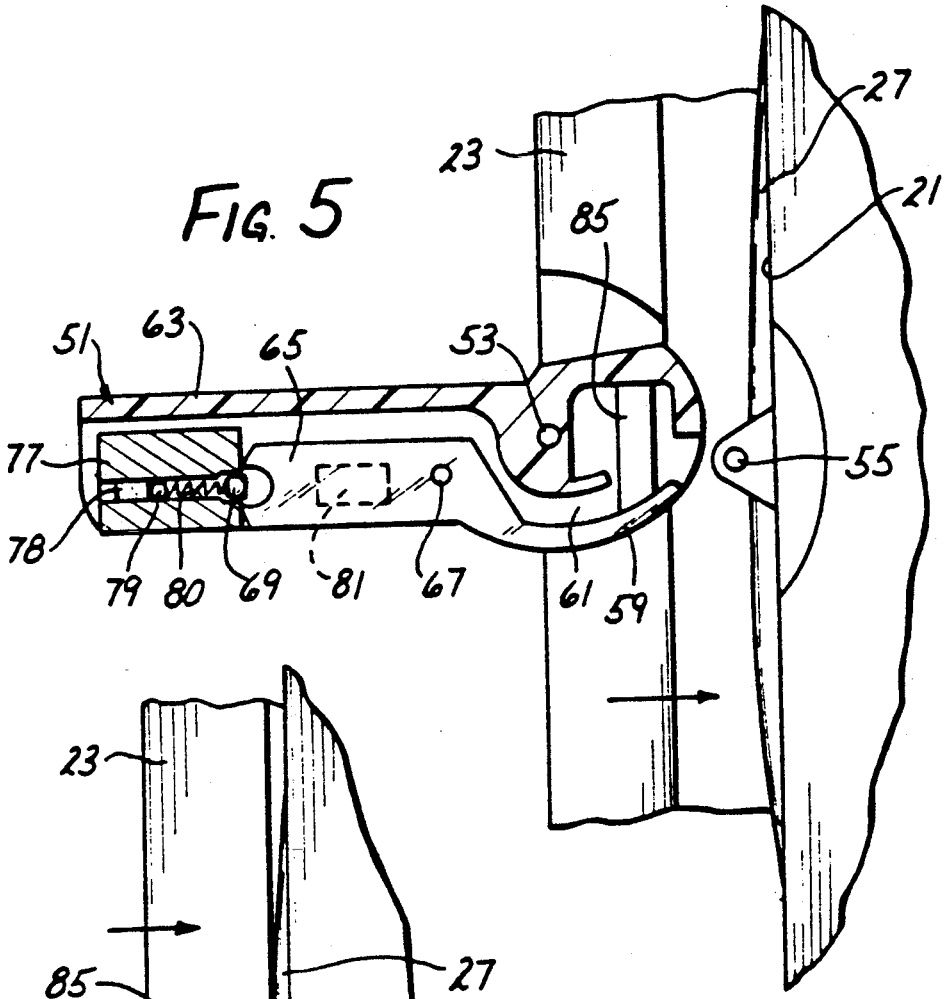
FIG. 5 is a view similar to FIG. 3 with the tube in the improper position.
Figure 6:
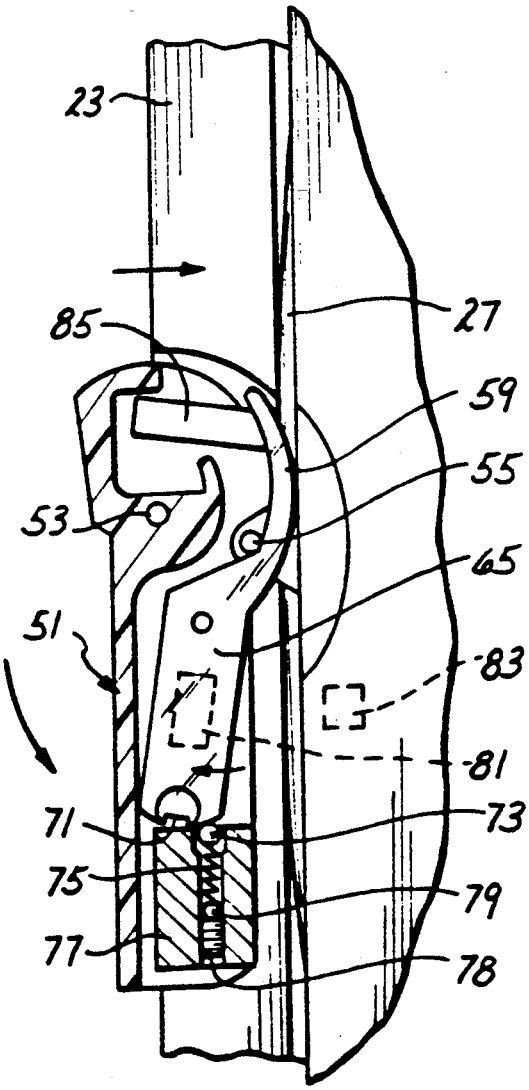
FIG. 6 is a view similar to FIG. 4 with the tube in the improper position restraining the door against movement to the closed position and with the arm being moved out of the detented or normal position.

This occurs when the tube 27 is in the improper position and restrains the door 23 against movement to the closed position In this regard, FIG. 5 shows a misloaded tube 27, i.e., a tube in the improper position, extending outwardly toward the door 23 from the base 21. The door 23 can be moved toward the closed position as shown in FIG. 5. However, when the pivotable latch member 51 is pivoted counterclockwise as viewed in FIGS. 5 and 6 toward the latching position, the door-closing force is so substantial that the force applied to the arm 65 is sufficient to move the arm out of the normal or detented position to a failure position shown in FIG. 6. Thus, the door-closing force is limited by the force required to force the arm 65 out of the detent 69. With the arm 65 out of its normal or detented position, the pivotable latch member 51 cannot be placed in the latching position, and the door 23 cannot be moved to the closed position. In fact, the pivotable movement of the arm 65 to the failure position allows the somewhat compressed tube 27 to move the door 23 slightly to the left as viewed in FIG. 6 to provide a visual indication that the door 23 is not in the closed position.

With this construction, the main body 63, the arm 65 and the fixed latch member 55 form an overcenter toggle mechanism which is over center in the latching position of FIG. 4 to draw the door 23 to the closed position and to lock the door in the closed position. The detent 69 provides breakaway means on this overcenter toggle mechanism which is responsive to a predetermined force on the toggle mechanism to prevent movement of the pivotable latch member to the latching position.

To provide an indication when the door is not in the closed position, a switch operator in the form of a magnet 81 is carried by the arm 65 and a switch, such as a magnetic switch 83 (FIGS. 4 and 6) is carried by the housing 19. The switch 83 is turned off by the proximity of the magnet 81 when the pivotable latch member 51 is in the latching position and is turned on by the diminished magnetic field when the pivotable latch member is not in the latching position. Consequently, this switching action can be used to provide an alarm and/or indicator for indicating whenever the door 23 is not in the closed position.

Figure 7:
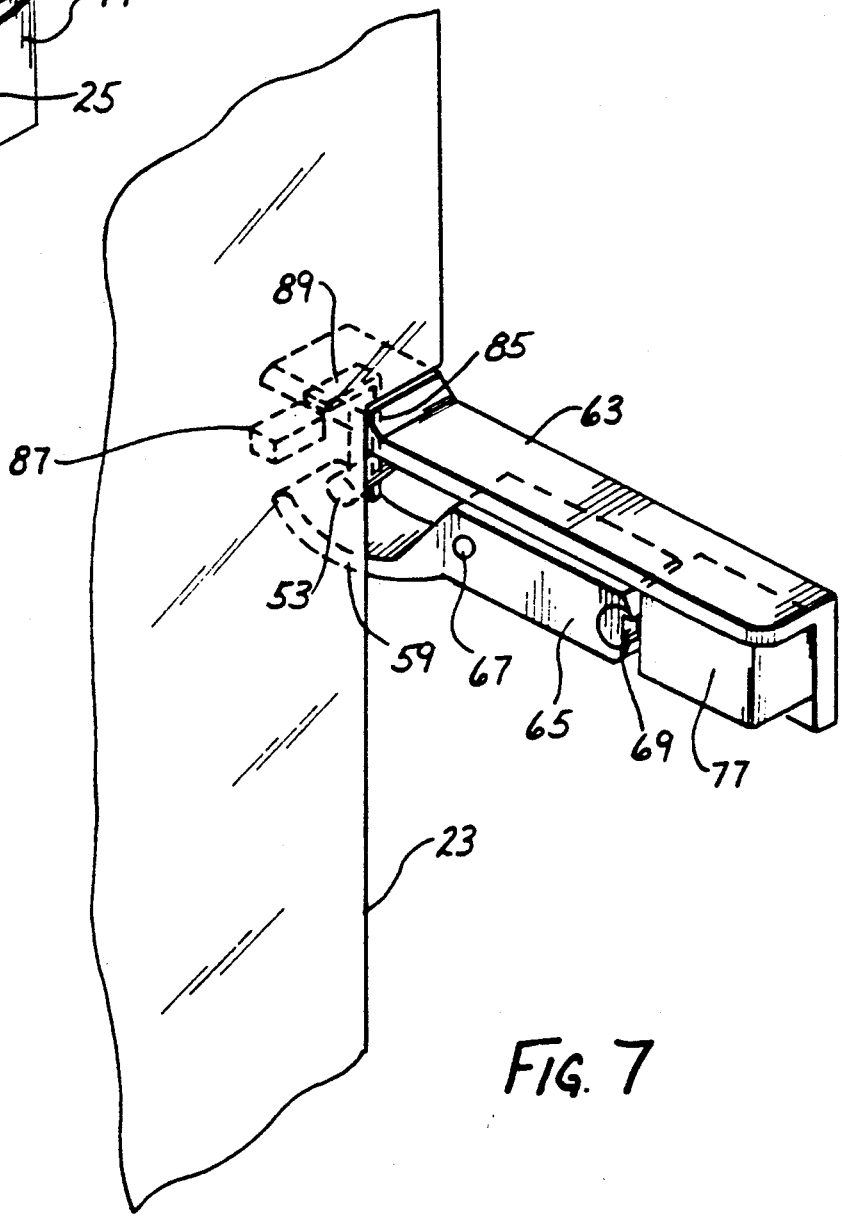
FIG. 7 is a fragmentary perspective view illustrating one way that the arm can be reset back to the normal position.

To reset the arm 65 back to the normal or detented position, this invention provides a reset member 85 (FIGS. 6 and 7) carried by the arm 65 and a stop 87 (FIG. 7) on the door 23. As best seen in FIG. 7, the reset member 85 is of generally L-shaped configuration and has a leg 89 which projects to the left as viewed in FIG. 7. As the pivotable latch member 51 is pivoted counterclockwise as viewed in FIG. 7, the leg 89 contacts the stop 87 at a reset location to apply a force to the reset member 85 which pivots the arm 65 about the pin 67 back to the normal or detented position. In this embodiment, the pivotable latch member 51 is horizontal in the reset location. Viewed from a different perspective, the releasing position of the pivotable latch member 51 comprises a range of positions which includes the reset location.

Although an exemplary embodiment of the invention has been shown and described, many changes, modifications and substitutions may be made by one having ordinary skill in the art without necessarily departing from the spirit and scope of this invention.

I claim:

1. An assembly comprising:

a supporting structure;

a door;

means for mounting the door on the supporting structure for pivotal movement between an open position and a closed position, said door being subject to being restrained against movement to the closed position;

a latch including a first latch member pivotally mounted on the door and a second latch member on the supporting structure, said first latch member being pivotable between a latching position in which the latch members are engaged to draw the door to the closed position and a releasing position in which the door is not locked in the closed position;

said first latch member including a main body and an arm pivotally mounted on said main body;

means for releasably retaining the arm in a normal position in which it is engageable with the second latch member during pivotal movement of the first latch member to the latching position to draw the door to the closed position; and said releasable retaining means being releasable in response to a predetermined force applied by the arm to the second latch member during pivotal movement of the second latch member toward the latching position as a result of the door being restrained against movement to the closed position to release the arm for pivotal movement to a failure position in which the latch is ineffective in drawing the door to the closed position.

2. An assembly as defined in claim 1 wherein said releasable retaining means includes a detent carried by said first latch member which is releasable in response to said predetermined force applied by the arm to the second latch member.

3. An assembly as defined in claim 1 including a switch carried by one of said supporting structure and said arm and a switch operator carried by the other of said supporting structure and arm, said switch being placed in one state by the switch operator when the first latch member is in said latching position and in a second state when the first latch member is not in the latching position.

4. An assembly as defined in claim 1 wherein said main body, arm and second latch member form an over-center toggle mechanism which is over center in the latching position to draw the door to the closed position and to lock the door in the closed position.

* * * * *